US007481591B2

(12) United States Patent
Dumler

(10) Patent No.: US 7,481,591 B2
(45) Date of Patent: Jan. 27, 2009

(54) APPLICATION FOR COSMETIC PRODUCT

(75) Inventor: Norbert Dumler, Ansbach (DE)

(73) Assignee: Geka Brush GmbH, Bechhofen-Waizendorf (DE)

( * ) Notice: Subject to any disclaimer, the term of this patent is extended or adjusted under 35 U.S.C. 154(b) by 169 days.

(21) Appl. No.: 11/501,063

(22) Filed: Aug. 9, 2006

(65) Prior Publication Data

US 2007/0048066 A1 Mar. 1, 2007

(30) Foreign Application Priority Data

Aug. 11, 2005 (EP) ..... 05017438

(51) Int. Cl.
*A46B 11/00* (2006.01)

(52) U.S. Cl. ..... 401/126; 401/122

(58) Field of Classification Search ..... 401/270, 401/126, 129, 130, 118, 122; 15/110; 132/317, 132/320

See application file for complete search history.

(56) References Cited

U.S. PATENT DOCUMENTS 5,772,347 A 6/1998 Gueret
5,931,594 A * 8/1999 Garcia ..... 401/126
6,331,085 B1 * 12/2001 Schrepf et al. ..... 401/128
7,261,483 B2 * 8/2007 Gueret ..... 401/126
2002/0048482 A1 4/2002 Gueret
2005/0063768 A1 3/2005 Tani
2006/0093425 A1 * 5/2006 Gueret ..... 401/129
2006/0165472 A1 * 7/2006 Dumler ..... 401/126

FOREIGN PATENT DOCUMENTS

EP 1 080 659 A2 3/2001
WO WO 02/056726 A2 7/2002

* cited by examiner

*Primary Examiner*—David J Walczak
(74) *Attorney, Agent, or Firm*—Browdy and Neimark, P.L.L.C.

(57) ABSTRACT

In an applicator for a cosmetic product comprising a rod and an application surface made of a relatively soft material and extending obliquely to the longitudinal axis of the rod, provision is made for said application surface to be formed by a plurality of cones arranged parallel to each other, wherein a fictitious outer envelope and the height of the cone define an application volume for a relatively highly viscous cosmetic product from 10 to 60 $mm^3$.

11 Claims, 2 Drawing Sheets

APPLICATION FOR COSMETIC PRODUCT

BACKGROUND OF THE INVENTION

1. Field of the Invention

The invention is directed to an applicator for a cosmetic product comprising a rod and an application surface made of a relatively soft material and extending obliquely to the longitudinal axis of the rod, said application surface being formed by a plurality of cones arranged parallel to each other.

2. Background Art

An applicator of this type is known from US 2002/0048482 A.

SUMMARY OF THE INVENTION

With this as the starting point, the invention has as its object to create an applicator, especially for a cosmetic lip product, whose application surface is textured such that the cosmetic preparation penetrates also into skin wrinkles or the like and is able to develop its therapeutic effect there and/or provide for an even, uniform coloring, while at the same time ensuring an optimal wiping action.

This object is met according to the invention in such a way that the application surface is provided on an applicator front part made of a soft material extending over a retention element made of a comparatively hard synthetic material, said retention element being inserted in a cavity of the rod, and the outer contour of the applicator front part and of the rod transitioning into each other without gradation.

These cones, with their free ends, define the application surface. They have a certain elasticity and movability and can therefore massage the cosmetic preparation, which is stored between them and/or within the rim of the application surface, into wrinkles and uneven areas.

As a result of the inventive joining of the applicator and the rod an exterior gradation is prevented, so that a problem-free wiping action is made possible.

The retention element is advantageously inserted in a cavity of the rod, in such a way that this cavity may taper approximately conically toward the proximal end and accommodate the retention element in a press fit.

The applicator front part may have a proximal annular shoulder sitting against the front face of the rod when inserted.

The length of the cones may advantageously be approximately 1 mm, with 10 to 100, preferably approximately 50 cones being provided.

The rod may be arranged in a manner known per se on a closing cap for a receptacle receiving a cosmetic preparation.

The invention also relates to a cosmetic unit comprising an applicator of the above-described type.

The invention will be explained in more detail below with the aid of a preferred embodiment in conjunction with the drawing.

DESCRIPTION OF A PREFERRED EMBODIMENT

Figure 1:
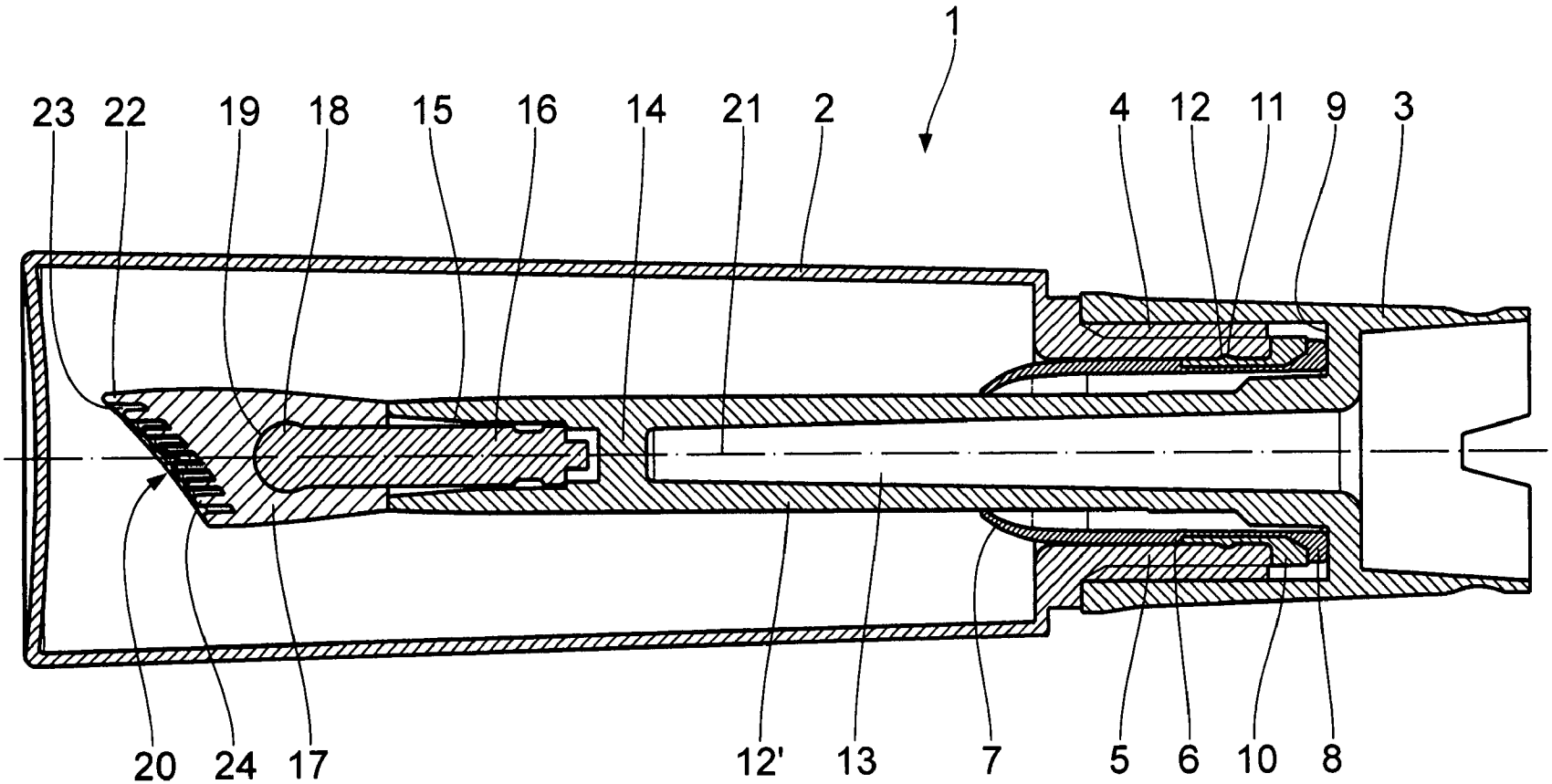
FIG. 1 shows a longitudinal section through a cosmetic unit provided with an inventive applicator.
Figure 2:
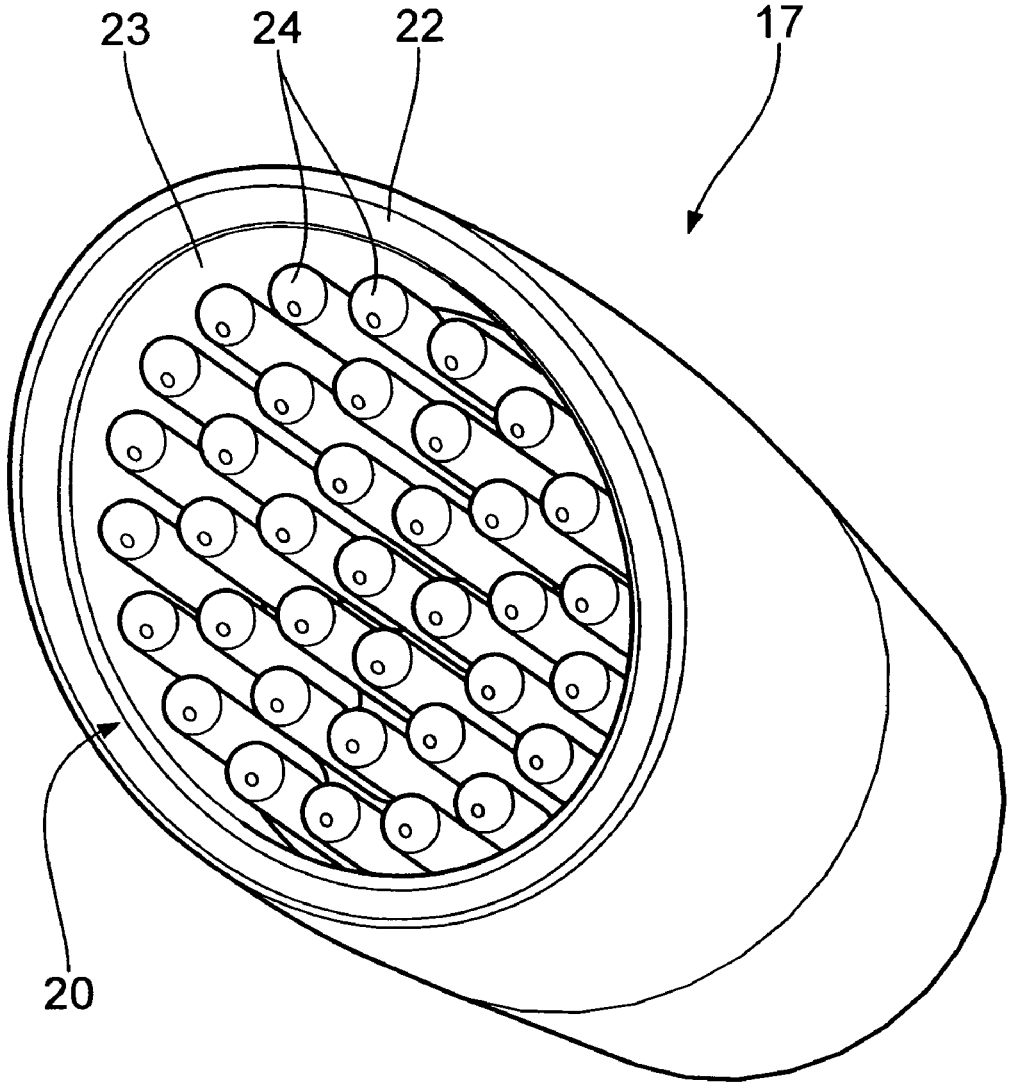
FIG. 2 shows a perspective view of the applicator front part and applicator surface.

A cosmetic unit 1 shown in the drawing comprises a receptacle 2 provided with a screw cap 3, which can be screwed onto an outside thread 4, which is formed on a tapered neck 5 of the receptacle 2.

Inserted in the receptacle neck 5 is a wiper unit 6, which is provided at its distal end with wiper lips 7. The wiper unit 6 extends over the front face of the receptacle neck 5 and in this manner, at the same time, forms a seal 8 that sits against a front face 9 of the screw cap 3 when the same is screwed on.

The wiper unit 6 also comprises an outer positioning extension 10 made of a different synthetic material, which has an annular bead 11 for engaging into a corresponding annular groove 12 on the inside of the receptacle neck 5.

Injection-molded as one piece with the screw cap 3 is a rod 12' having an interior longitudinal cavity 13, which is sealed off by a transverse wall 14.

Formed at the distal end of the rod 12' is an inwardly conically tapered cavity 15, in which a retention element 16 is inserted, to which an applicator front part 17 made of a softer synthetic material is secured in such a way that the retention element 16 has a spherical thickening 18, which engages into a corresponding cavity 19 of the applicator front part 17.

An application surface 20 of the applicator front part 17 extends obliquely to the longitudinal axis 21 of the rod 12' and is slightly concavely arched inward. It is bordered by a rim 22, which is designed The rim 22 encloses a cavity 23 in which a plurality of cones 24 arranged parallel to each other are disposed, which are injection-molded as one piece with the applicator front part 17 and whose free outer ends define the application surface 20.

What is claimed is:

1. An applicator for a cosmetic product comprising a rod and an application surface (20) made of a relatively soft material and extending obliquely to the longitudinal axis of the rod, said application surface (20) being formed by a plurality of soft and flexible cones arranged parallel to each other, wherein the application surface (20) is formed on an applicator front part (17) having an outer contour and being made of a soft material extending over a retention element (16) made of a comparatively hard synthetic material, said retention element (16) being inserted in a cavity of the rod (12'), and the outer contour of the applicator front part (17) and of the rod (12') transitioning into each other without gradation, wherein said cones (24) are adapted to a capable of massaging cosmetic into skin wrinkles.

2. An applicator according to claim 1, wherein the cavity of the rod (12') tapers approximately conically toward the proximal end and accommodates the retention element (16) in a press fit.

3. The applicator of claim 2 wherein said retention element (16) comprises, at one end thereof opposite said press fit into the cavity of the rod (12'), a spherical thickening (18) which engages into a corresponding cavity (19) of the applicator front part (17).

4. An applicator according to claim 1, wherein the applicator front part (17) has a proximal annular shoulder sitting against the front face of the rod (12') when inserted.

5. An applicator according to claim 1, wherein the length of the cones (24) is approximately 1 mm.

6. An applicator according to claim 1, wherein 10 to 100 cones (24) are provided.

7. Applicator of claim 6 wherein the number of cones is approximately 50.

8. An applicator according to claim 1, wherein the rod (12') is arranged on a closing cap for a receptacle (5) receiving a cosmetic preparation.

9. In a cosmetic unit comprising a container for a cosmetic and an applicator, the improvement wherein the applicator is according to any one of claims 1 or 2 through 8.

10. The applicator of claim 1 wherein the application surface (20) is slightly concave.

11. The applicator of claim 1 wherein the application surface (20) further comprises a border or rim (22) extending around said cones (24).

* * * * *